US006721995B2

(12) United States Patent
Cress et al.

(10) Patent No.: US 6,721,995 B2
(45) Date of Patent: Apr. 20, 2004

(54) HINGE

(75) Inventors: David R. Cress, Janesville, WI (US); Thomas Barnett, Freeport, IL (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/851,262

(22) Filed: May 8, 2001

(65) Prior Publication Data

US 2002/0166209 A1 Nov. 14, 2002

(51) Int. Cl.[7] ..... E05D 5/00
(52) U.S. Cl. ..... 16/382; 16/236; 16/252
(58) Field of Search ..... 16/382, 235, 236, 16/237, 252, 239, 240, 387

(56) References Cited

U.S. PATENT DOCUMENTS

| | | | | | |
|---|---|---|---|---|---|
| 190,343 | A | * | 5/1877 | Lash | 16/387 |
| 4,554,706 | A | | 11/1985 | Röck et al. | 16/237 |
| 4,604,769 | A | | 8/1986 | Röck et al. | 16/238 |
| 4,716,622 | A | * | 1/1988 | DeBruyn | 16/297 |
| 4,803,749 | A | | 2/1989 | Röck et al. | 16/237 |
| 4,825,509 | A | * | 5/1989 | Mitchell et al. | 16/254 |
| 4,982,475 | A | * | 1/1991 | Killingstad | 16/257 |
| 5,027,474 | A | * | 7/1991 | Bowers | 16/297 |
| 5,191,677 | A | | 3/1993 | Lautenschläger et al. | 16/257 |
| 5,327,616 | A | | 7/1994 | Lautenschläger | 16/382 |
| 5,355,557 | A | | 10/1994 | Cress et al. | 16/286 |
| 5,392,493 | A | | 2/1995 | Youngdale | 16/237 |
| 5,454,144 | A | | 10/1995 | Rupprechter | 16/382 |
| 5,485,656 | A | * | 1/1996 | Domenig | 16/248 |
| 5,588,181 | A | * | 12/1996 | Sutton | 16/252 |
| 5,604,956 | A | | 2/1997 | Grass | 16/278 |
| 5,752,291 | A | * | 5/1998 | Snyder | 16/235 |
| 5,930,866 | A | | 8/1999 | Rupprechter | 16/242 |
| 6,049,946 | A | | 4/2000 | Cress et al. | 16/240 |
| 6,125,510 | A | | 10/2000 | Domenig | |
| 6,163,930 | A | * | 12/2000 | King | 16/237 |
| 6,167,590 | B1 | | 1/2001 | Domenig | |
| 6,170,121 | B1 | | 1/2001 | Domenig | |

* cited by examiner

*Primary Examiner*—Chuck Y. Mah
(74) *Attorney, Agent, or Firm*—Marshall, Gerstein & Borun LLP

(57) ABSTRACT

A cabinet hinge configured to pivotally couple a cabinet door to a frame is disclosed. The frame includes an edge with a first side and a second side. The cabinet hinge includes a door wing configured to be mounted to the cabinet door. The cabinet hinge also includes a frame wing configured to be mounted to the frame and including a wrap portion. The wrap portion includes a first wrap portion configured to wrap around the first side of the frame and the second wrap portion configured to wrap around the second side of the frame. The first wrap portion is configured to extend along the cabinet frame a sufficient distance to prevent splitting of the frame material under normal usage and following normal mounting procedures. The cabinet hinge also includes a hinge arm configured to pivotally couple the door wing and the frame wing. The first wrap portion is configured with a raised surface configured to contact the frame first side.

4 Claims, 4 Drawing Sheets

HINGE

FIELD OF THE INVENTION

The present invention relates to a hinge to mount a door to a frame. Specifically, the present invention relates to a hinge to mount a door to a frame, the door and/or frame being made particularly from thin medium density fiber board (MDF) or thin particle board.

BACKGROUND

It is generally known to provide a hinge for mounting a door to a frame. Conventional hinges typically mount to an edge of a frame using screws. Screws are generally inserted into the edge of the frame, parallel to the surface of the frame. However, as a screw is inserted into the frame, there is a tendency for the frame material to fail causing a split in the frame material due to the wedging force of the screw. This problem is magnified when the frame member is made of thin particle board, thin multi-density fiber board, thin plywood, or thin wood. When the screws are tightened into the ends of thin materials, the material can crack, split, or break, thereby damaging the frame, and possibly rendering the frame unusable.

Hinges are conventionally assembled of two pieces including a frame wing, which is attached to the frame, pivotally coupled to a hinge cup, which is attached to a door. The frame wing commonly includes a set of flanges. The flanges are configured to provide guidance of the frame wing onto the frame during mounting. Because the flanges, which extend along the surfaces of the frame edge are relatively short, they provide little or no holding power during the mounting of the frame wing to the frame, nor do they provide any bend back resistance or resistance to frame material failure.

Conventionally, during mounting of the frame wing to a frame, a user must hold the frame wing against the frame with one hand while setting a screw with the other hand. Such two hand mounting procedures may be inconvenient as well as difficult.

Further, during operation, a hinge is used to allow movement of a door from a closed position, through a partially open position, to a fully open position. A user of the door may attempt to "over open" the door by pushing the door in the door opening direction, to a position past "fully open." Such "over opening" may cause the flange of the frame wing to dig into and damage the frame, may cause the screw to be pulled out of the frame and/or may cause the frame to fail by cracking, breaking, or splitting.

Because of the relative shortness of conventional frame wing flanges, conventional flanges fail to provide substantial "bend back resistance," that is, resistance to the door being "over opened," so as to prevent damage to the frame. Also, because of the relative shortness of the flanges, the frame wing has little or no holding power which may be advantageous during mounting of the frame wing to the frame. Further, because of the relative shortness of the flanges, the flanges do not aid in constraining the frame material to prevent the frame material from cracking, splitting, or breaking.

Accordingly, there is a need to provide a hinge which is suited to be used on thin particle board, thin MDF, or other thin frame materials and minimizes possible damage to these types of materials. There is also a need to provide a hinge that significantly improves the bend back resistance of the frame/hinge combination. Further, there is a need to provide a hinge which assists a user in installing the cabinet door before screws are inserted. Further still, there is a need to provide a hinge which enhances the holding power of the hinge relative to a surface. Yet further still, there is a need to provide for a hinge having one or more of these or other advantageous features.

The techniques herein below extend to those embodiments which fall within the scope of the appended claims, regardless of whether they accomplish one or more of the above-mentioned needs.

SUMMARY

The present invention relates to a cabinet hinge configured to pivotally couple a cabinet door to a frame having an edge with a first side and a second side. The cabinet hinge includes a door wing configured to be mounted to the cabinet door, a frame wing configured to be mounted to the frame. The frame wing includes a wrap portion. A hinge arm is configured to pivotally couple the door wing and the frame wing. The wrap portion includes a first wrap portion that is configured to wrap around the first side of the frame and a second wrap portion that is configured to wrap around the second side of the frame and the first wrap portion is configured to extend along the cabinet frame a sufficient distance to prevent splitting of the frame material under normal usage and following normal mounting procedures and the first wrap portion configured with a raised surface configured to contact the frame first side.

The present invention also relates to a hinge for pivotally coupling a door to a frame being constructed of a thin medium density fiberboard (MDF) or thin particle board. The hinge includes a door portion configured to be mounted to the door and a base portion pivotally coupled to the door portion, where the base portion configured to be mounted on an edge of the frame with a fastener. The hinge further includes a first wrap portion extending from the base portion along a front surface of the frame and a second wrap portion extending from the base portion along a rear surface of the frame. The first wrap portion extends along the surface of the frame a distance in the range of approximately 0.15 to 0.75 inches. The second wrap portion extends along the surface of the frame a distance in the range of approximately 0.4 to 1.0 inches.

The present invention further relates to a cabinet hinge configured to pivotally couple a cabinet door to a frame having an edge with a first side and a second side. The cabinet hinge includes a door wing configured to be mounted to the cabinet door, an insert having a hinge arm configured to pivotally couple the door wing and the insert, and a wrap portion configured to be coupled to the frame. The wrap portion being interchangeable with the insert, the wrap portion including an apperture configured to accept the insert, the wrap portion selectively sized to fit around the frame edge.

DESCRIPTION OF THE FIGURES

The invention will become more fully understood from the following detailed description, taken in conjunction with the accompanying drawings, wherein like reference numerals refer to like elements, in which.

DETAILED DESCRIPTION OF EXEMPLARY EMBODIMENTS

Figure 1:
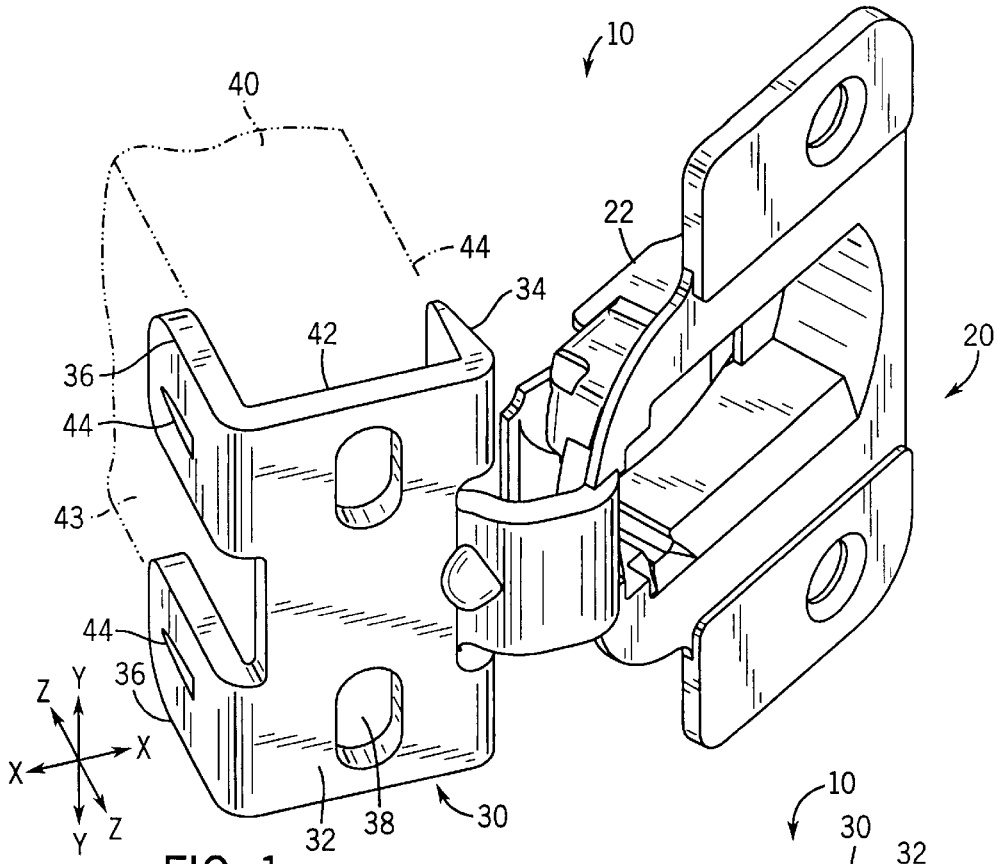
FIG. 1 is a front perspective view of a cabinet hinge having a mounting cup and a frame wing coupled thereto according to an exemplary embodiment.

Referring to FIGS. 1–8, exemplary embodiments of a hinge for mounting a cabinet door to a cabinet frame are shown. It should be noted at the outset that the hinge can be used in any of a wide variety of cabinet doors and other doors, including concealed and unconcealed hinge arrangements known to those skilled in the art who may review the disclosure. Referring to FIG. 1, an exemplary embodiment of a hinge 10 is shown. Hinge 10 is used to mount a cabinet door or door stile for selective pivotal movement between an open position (depicted in FIG. 1) and a closed position with respect to a frame 40.

Hinge 10 includes a door wing 20 pivotally coupled to a frame wing 30. Door wing 20 is shown as a hinge cup type door wing, and is adapted to be mounted into and within a substantially cylindrical bore or recess in a door. Hinge cup 22 may be adapted to fit into other bore geometries, not limited to substantially cylindrical. Frame wing 30 is adapted to be mounted to an edge 42 of frame 40 as depicted in FIG. 1. According to an exemplary embodiment, the hinge arrangement shown, having hinge cup 22 substantially embedded in a door, and having frame wing 30 mounted to edge 42 of frame 40, is an arrangement designed to conceal the hinge from view when viewed from the front of a cabinet. This arrangement is commonly known in the art as a "concealed" hinge.

Frame wing 30 includes base 32, front wrap 34, and rear wrap 36. As depicted in FIG. 1, base 32 is a substantially flat, rectangular plate having a width, along horizontal axis X—X, substantially corresponding to a width of frame 40. In an exemplary embodiment, base 32 has a width of approximately 0.6 inches, however, any base width may be used depending on the thickness of the frame material to be used. Furthermore, base 32 is oriented substantially perpendicular to rear frame surface 43 and front frame surface 44.

Figure 4:
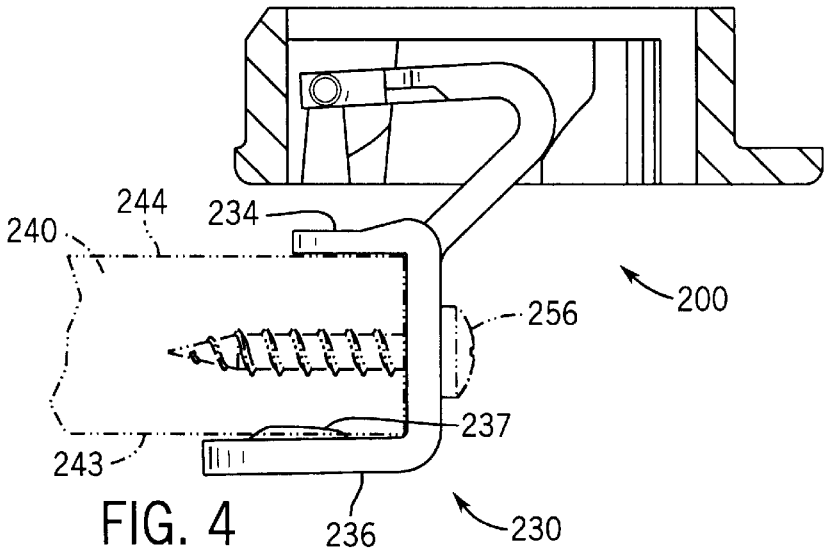
FIG. 4 is a top view of the cabinet hinge shown in FIG. 3.

As shown in FIG. 1, base 32 includes mounting slots 38, shown as oblong apertures in base 32. Mounting slots 38 are configured to receive fasteners, such as but not limited to wood screw 56 (FIG. 4). Wood screw 56 is inserted through mounting slot 38 and screwed into frame 40, rigidly coupling frame wing 30 to frame 40. Once attached to frame 40, frame wing 30 may be adjusted in a vertical direction (shown as vertical axis Y—Y) by loosening wood screws 56 and sliding frame wing 30 along axis Y—Y. The limit of vertical adjustment is bounded by the length of mounting slot 38.

Frame wing 30 further includes rear wraps 36 and front wraps 34. Rear wraps 36 and front wraps 34 extend substantially perpendicular to base 32, and are substantially parallel with frame surface 43. In an exemplary embodiment, front wrap 34 has a width, along vertical axis Y—Y, of approximately 1.6 inches. Alternatively, front wrap 34 may have any appropriate width. In an exemplary embodiment, front wrap 34 has a depth, along depth axis Z—Z, of approximately 0.3 inches or anywhere in the range of approximately 0.15 to 0.75 inches. Alternatively, front wrap 34 may have any appropriate depth depending on the frame material. In an exemplary embodiment, rear wrap 36 has a depth, along depth axis Z—Z, of approximately 0.6 inches or anywhere in the range of approximately 0.4 to 1.0 inches. Alternatively, rear wrap 36 may have an appropriate depth to support the frame material.

Figure 2:
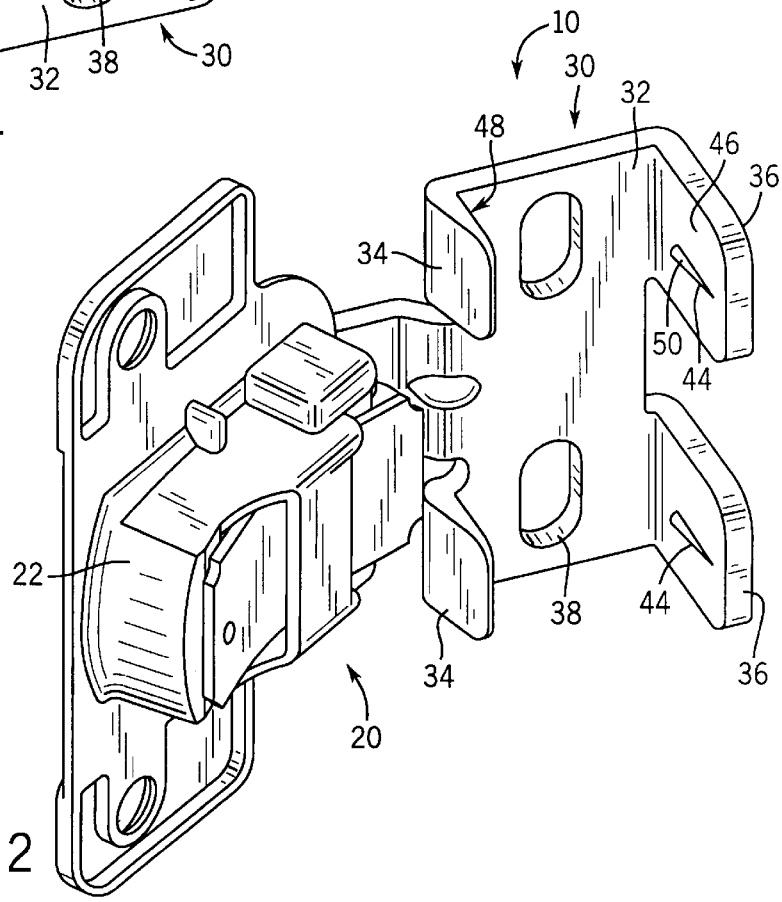
FIG. 2 is a rear perspective view of the cabinet hinge shown in FIG. 1.

Shown in FIGS. 1–2, rear wrap 36 and front wrap 34 further include ribs 44. In an exemplary embodiment rib 44 is a raised surface on inner surfaces 46 of rear wraps 36 and inner surfaces 48 of front wraps 34. Raised surface 50 of rib 44 may be in the shape of a portion of a cone. Alternatively, rib 44 may be any of a variety of textured surfaces, including, but not limited to slotted, knurled, and/or other raised surfaces.

As discussed above, hinge 10 is used to mount a cabinet door or door sitle for selective pivotal movement between an open position and a closed position. In attaching hinge 10 to frame 40, frame wing 30 is slid over edge 42, located in a desired mounting position. As frame wing 30 is slid over edge 42, ribs 44 wedge into the front and rear of frame surface 43 of cabinet frame 40. As ribs 44 wedge into frame surface 43, they operate to grab frame 40, thereby assisting to hold hinge 10 in place prior to wood screws 56 being inserted. Accordingly, an installer mounting frame wing 30 to edge 42 of frame 40 could slide frame wing 30 onto edge 42. Frame wing 30 would be substantially held in position by ribs 44 even if the installer does not hold frame wing 30. Therefore, the installer may concentrate on positioning and inserting screws 56.

Figure 3:
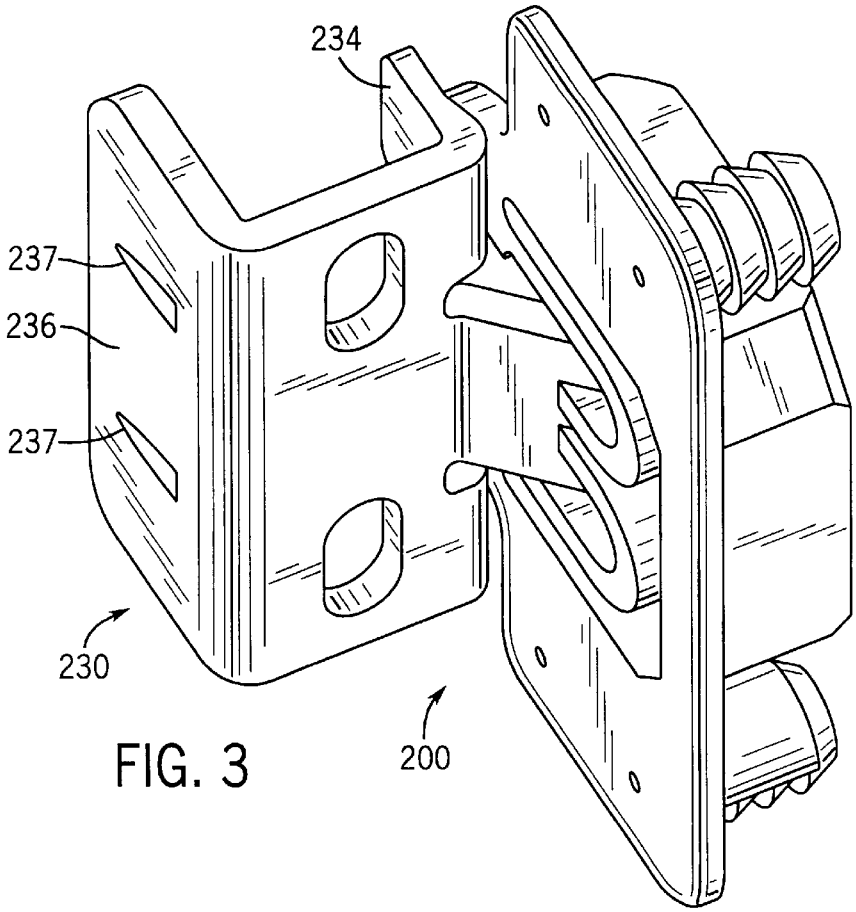
FIG. 3 is a front perspective view of a cabinet hinge having a mounting cup and a frame wing coupled thereto according to an alternative embodiment.

As shown in FIGS. 3 and 4, but equally applicable to alternative embodiments such as, but not limited to, those embodiments depicted in FIGS. 1–2, and 5–8, to attach a frame wing 230 to a frame 240, wood screw 256 is screwed into frame 240. As wood screw 256 is further tightened into frame 240, the frame material tends to separate or be wedged apart by wood screw 256. Because rear wrap 236 and front wrap 234 are elongated and extend along surfaces 243 and 244 a significant distance, rear wrap 236 and front wrap 234 serve to constrain the material of frame 240 from expanding due to the wedging force of wood screw 256. Hinge 200 includes a single flange rear wrap 236, as depicted in FIG. 3 having ribs 237 formed on rear wrap 236. It should be noted that FIGS. 3 and 4 are representative of the many and varied configurations of both rear wraps 236 and front wraps 234.

In an exemplary embodiment, frame wing 30 may be configured to fit on a frame having a thickness in a range of ¼ inch to 1 inch, however, other frame material sizes may be used as well. Such materials include, but are not limited to medium-density fiberboard (MDF), other fiberboard, particle board, plywood, wood, etc.

Referring again to FIGS. 1 and 2, the oversized front and rear wraps 36 and 34 offer several advantages. One such advantage is front wrap 34 and rear wrap 36 help to prevent frame 40, which, in an exemplary embodiment, is made from thin MDF or thin particle board, from cracking, splitting, or breaking. Front wrap 34 and rear wrap 36 prevent damage by applying a holding force to frame surface 43 when wood screws 56 are inserted into frame 40, thereby preventing frame 40 from expanding due to the wedging force exerted by wood screws 56.

Furthermore, in addition to ribs 44, the oversized front and rear wraps 34 and 36 increase the holding power of hinge 10 during mounting. Because wraps 34 and 36 are elongated, more contact occurs between wraps 34 and 36 than conventional devices. Such increased contact area provides additional frictional interference adding to the holding power of frame wing 30.

Because of the oversized front and rear wraps 34 and 36 and ribs 44, the bend-back resistance of frame wing 30 and frame 40 combination is improved. As a door coupled to frame wing 30 is "over opened" past a nominal point, wrap 34 will distribute the opening force over surface 43, helping to resist breakage, failure, cracking, or splitting of the material of frame 40. Further, ribs 44 help to prevent movement of wing 30 relative to frame 40, such that less pull out force is exerted on screw 56. Accordingly, because of the unique design of frame wing 30, screw 56 is less likely to be pulled out from edge 42 and the material of frame 40 is less likely to be damaged.

According to an alternative embodiment, depicted in FIGS. 5–8, frame wing 130 may be a two piece design. Frame wing 130 includes insert 160 and interchangeable wrap 180.

Figure 6:
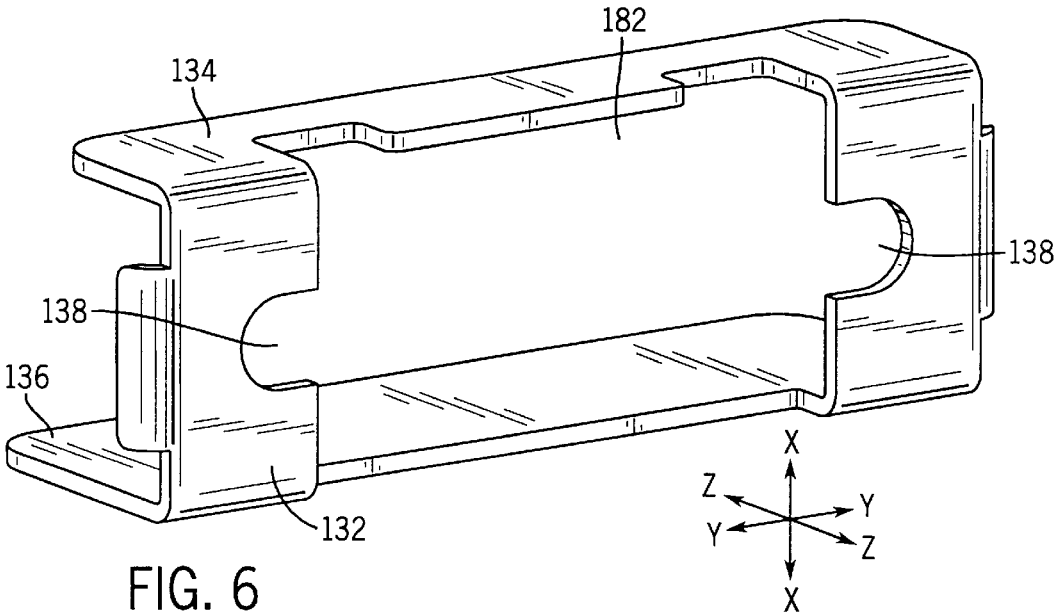
FIG. 6 is a front perspective view of an interchangeable wrap of the frame wing shown in FIG. 5.
Figure 5:
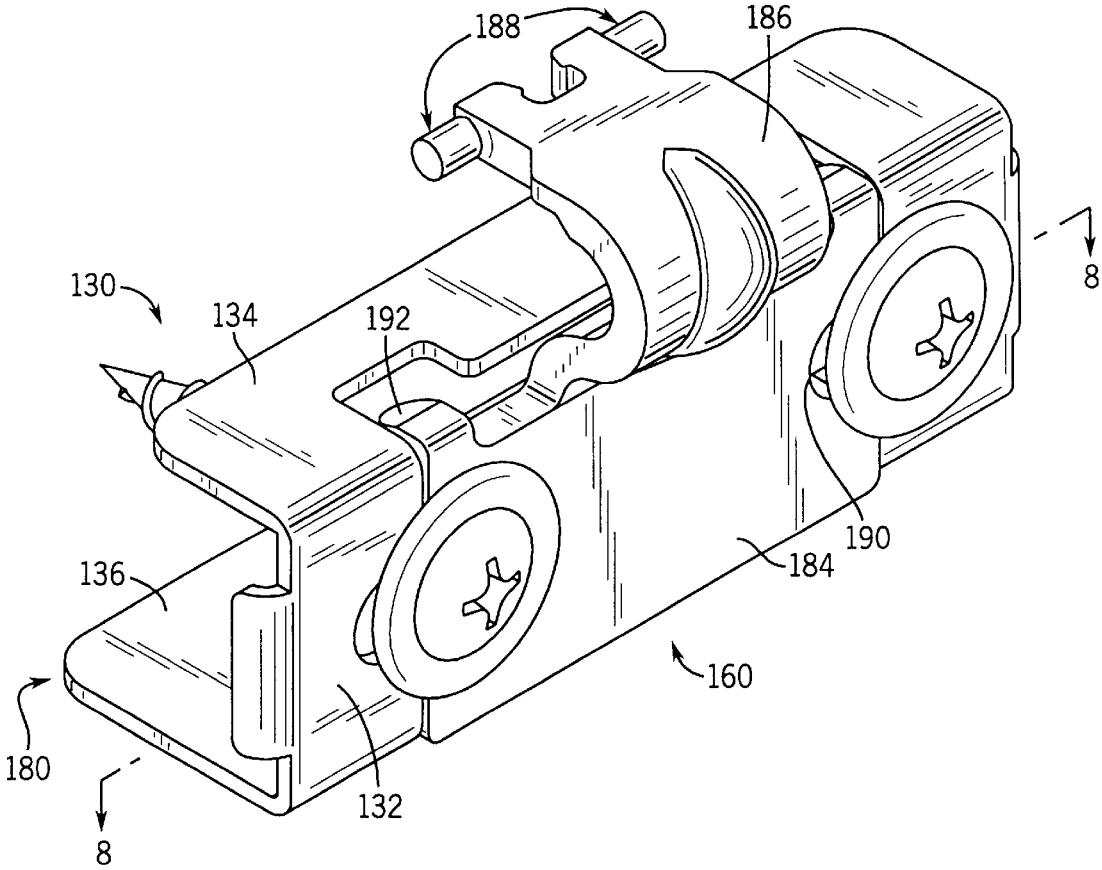
FIG. 5 is a front perspective view of a frame wing according to an alternative embodiment.
Figure 7:
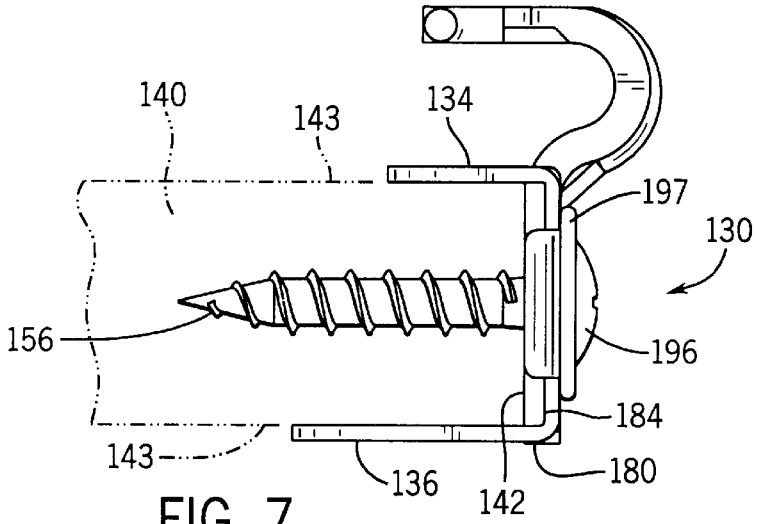
FIG. 7 is a top view of the frame wing shown in FIG. 5.

Interchangeable wrap 180 includes base 132, front wrap 134, and rear wrap 136. As shown in FIG. 6, base 132 is a substantially flat, rectangular portion having a width, along horizontal axis X—X, substantially corresponding to a width of frame. Base 132 is oriented substantially perpendicular to frame surface 142.

Base 132 further includes aperture 182 located within base 132. Aperture 182 is sized to receive insert 160 as will be discussed below. Aperture 182 is substantially centered within base 132 but may be alternatively located at any location along base 132. As shown in FIG. 6, interchangeable wrap 180 further includes wrap slots 138. Wrap slots 138 are exemplary disposed substantially along a center-line axis of base 132, on an outer edge of aperture 182.

Interchangeable wrap 180 further includes front wraps 134 and rear wraps 136. Rear wraps 136 and front wraps 134 extend substantially perpendicular to base 132, and are substantially parallel with frame surface 143. In an exemplary embodiment, rear wrap 136 may be configured with surface textures, such as, but not limited to ribs, which serve the same function as ribs 44, depicted in FIG. 2.

Frame wing 130 further includes insert 160. Insert 160 includes plate 184, hinge arm 186, and pivots 188. Plate 184 is a substantially flat, rectangular portion having a size substantially corresponding to the size of aperture 182. Plate 184 further includes insert slots 190 disposed substantially along a center-line axis of plate 184, on an outer edge of plate 184. Plate 184 further includes wraps 192 which are substantially perpendicular to plate 184, and are configured to correspond to the width of interchangeable wrap 180. Alternatively, wraps 192 may be omitted.

Figure 8:
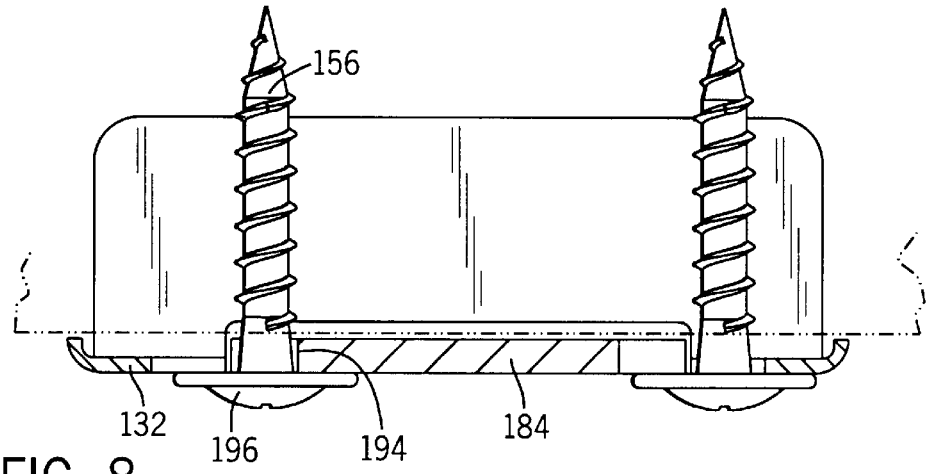
FIG. 8 is a cross sectional view of the frame wing shown taken across the line 8—8 in FIG. 5.

Insert 160 and interchangeable wrap 180 are assembled to form frame wing 130 which may be attached to frame 140. Interchangeable wrap 180 is slid over edge 142, located in a desired mounting position. As frame wing 130 is slid over edge 142, optional ribs wedge into the front and rear of frame surface 143 of frame 140, thereby assisting to hold frame wing 130 in place prior to assembly. Insert 160 is then fitted into aperture 182. Alternatively, because wraps 134 and 136 are oversized and elongated, wraps 134 and 136 grip frame edge 142 by a frictional interference fit and help to align plate 184 in place prior to assembly. When insert 160 is placed in aperture 182, insert slots 190 and wrap slots 138 are aligned to form fastener hole 194 (FIG. 8). Fasteners, shown as wood screws 156, are then attached to frame 140. Head 196 of wood screws 156 applies a force to both base 132 and plate 184, thereby preventing both interchangeable wrap 180 and insert 160 from moving. Wood screws 156 may be used with an optional washer or may be washer head screws having a large flange 197 which acts as a washer but is integrated into screw 156. Frame wing 130 may be adjusted by loosening wood screws 156 and sliding frame wing along axis Y—Y. The limit of adjustment is bounded by the length of fastener hole 194.

The two piece design of frame wing 130 offers several advantages. One such advantage is reducing the number of sized parts required to assemble frame wing 130. In other words, plate 184 may be used in conjunction with a variety of bases 132 which may be sized for different frame widths. For example, the same insert 160 may be used for cabinet frames utilizing frame material of a variety of different thicknesses. If, for example, a cabinet frame is built using ¾ inch MDF and another is built using ½ inch MDF, the same insert 160 may be used for both cabinets, thereby requiring only different frame wings 130. Also the frame wing dimensions may be varied to optimize performance characteristics depending on the frame material being used. Also, plate 184 may be easily interchanged with a plate having a different hinge arm 186 configuration or hinge arm type.

It is also important to note that the construction and arrangement of the elements of the hinge shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the scope of the present inventions as expressed in the appended claims.

What is claimed is:

1. A cabinet hinge configured to pivotally couple a cabinet door to a frame, the frame having an edge with a first side and a second side, the cabinet hinge comprising:

a door wing configured to be mounted to the cabinet door;

an insert having a hinge arm configured to pivotally couple the door wing and the insert, the insert being at least partially in contact with the frame; and a wrap portion configured to be coupled to the frame, wherein the wrap portion is separable from the insert, and wherein the wrap portion includes an aperture configured to accept the insert.

2. The cabinet hinge of claim 1, wherein the wrap portion and the insert are shaped to form a fastener aperture.

3. The cabinet hinge of claim 1, wherein the wrap portion includes at least one raised surface to engage the frame edge.

4. A cabinet hinge configured to pivotally couple a cabinet door to a frame, the frame having an edge with a first side and a second side, the cabinet hinge comprising:

a door wing configured to be mounted to the cabinet door;

an insert having a hinge arm configured to pivotally couple the door wing and the insert; and a wrap portion configured to be coupled to the frame, wherein the wrap portion is separable from the insert, the wrap portion including an aperture configured to accept the insert, wherein the insert and wrap portion are configured to be coupled to the frame by at least one screw, the screw having a head that engages the wrap portion and the insert.

* * * * *